US011661738B2

(12) United States Patent
Love et al.

(10) Patent No.: US 11,661,738 B2
(45) Date of Patent: May 30, 2023

(54) LATCH CONNECTOR FOR PROFILE BEAMS AND TUBES

(71) Applicants: Eric Carl Love, Maple (CA); Gilles Alain Martin Grant Rumfels, Toronto (CA)

(72) Inventors: Eric Carl Love, Maple (CA); Gilles Alain Martin Grant Rumfels, Toronto (CA)

( * ) Notice: Subject to any disclaimer, the term of this patent is extended or adjusted under 35 U.S.C. 154(b) by 4 days.

(21) Appl. No.: 17/241,728

(22) Filed: Apr. 27, 2021

(65) Prior Publication Data

US 2022/0341161 A1 Oct. 27, 2022

(51) Int. Cl.

| | |
|---|---|
| ***E04C 2/38*** | (2006.01) |
| ***E04B 2/74*** | (2006.01) |
| ***E04B 1/41*** | (2006.01) |

(52) U.S. Cl.

CPC ..... *E04B 2/7433* (2013.01); *E04B 1/40* (2013.01)

(58) Field of Classification Search

CPC ..... E04B 2001/2448; E04B 1/19; E04B 1/40; E04B 2/7433

USPC ..... 52/656.9

See application file for complete search history.

(56) References Cited

U.S. PATENT DOCUMENTS

| | | | | |
|---|---|---|---|---|
| 4,104,838 | A * | 8/1978 | Hage | E04B 2/7433 52/239 |
| 5,474,501 | A * | 12/1995 | Teng | A63J 11/00 403/311 |
| 7,698,860 | B2 * | 4/2010 | Hockemeyer | E04H 1/1205 182/186.7 |
| 8,549,779 | B2 * | 10/2013 | Ceurvels | G09F 15/0068 40/607.1 |
| 10,253,500 | B2 * | 4/2019 | Edoo | E04C 5/07 |
| 2007/0197082 | A1 * | 8/2007 | Zeh | E04B 2/7433 439/404 |
| 2008/0066414 | A1 * | 3/2008 | Gosling | E04B 2/7425 52/588.1 |
| 2012/0167500 | A1 * | 7/2012 | Henriott | A47B 96/06 160/369 |
| 2014/0341647 | A1 * | 11/2014 | Stoeckler | E04B 2/7433 403/345 |

* cited by examiner

*Primary Examiner* — Basil S Katcheves
(74) *Attorney, Agent, or Firm* — Elias Borges

(57) ABSTRACT

Herein is disclosed a latch mechanism for latching together extruded support members used to construct temporary partitions and the like. The latch mechanism consists of a latch and strike plate combination wherein a latch is placed at the end of one extrusion and a strike plate is positioned at the end of a second extrusion. The strike plate has hooks and the latch has a bail which is dimensioned to engage the hooks. Each of the latches are switchable between an unlocked orientation wherein the bail is free from the hooks and a locked position wherein the bail engages the hooks and biases the two extrusions together. The strike plate, bail, and hooks are dimensioned and configured such that up to four extrusions can be latched around a single fifth central extrusion.

20 Claims, 10 Drawing Sheets

LATCH CONNECTOR FOR PROFILE BEAMS AND TUBES

FIELD OF THE INVENTION

The invention relates generally to devices for assembling modular office partitions.

BACKGROUND OF THE INVENTION

A majority of interior space in the market consists of a space which is divided into a plurality of smaller spaces of varying size. Oftentimes, undivided space is provided to allow tenants added flexibility to customize the space as they see fit. Sometimes, spaces such as restaurants, retail space, office space and the like require partitions and walls to be erected to create either additional privacy or to section off portions of the space from the rest of the space. Modular partition kits and components are available to allow tenants to construct partitions and barriers to build dividers, restaurant booths, walls, cubicles, enclosures, fences, kiosks and even offices of custom sizes and orientations. These components include elongated extrusions which can be used to form vertical columns and horizontal beams to which walls, windows, doors, screens, partitions and a variety of other structures can be mounted to. Assembling these components to transform a bare space (or an already existing divided space) into customized ergonomic space requires time and effort to assemble the constituent components into the desired orientations. A significant part of the effort required is consumed by attaching horizontal beams to vertical columns. Generally, this is accomplished by using fasteners such as screws and bolts in combination with brackets to mount the beams and columns together. This of course requires various tools and precise measuring as well as significant labor in order to build the desired construction. Disassembling the construction in order to re-configure the space also requires tools and significant labor. The process of assembling and dissembling the component beams and columns would be significantly simplified if the components could be assembled and disassembled without the need of tools. A system for securely mounting beams and columns together without the need for tools is therefore desirable.

SUMMARY OF THE INVENTION

In accordance with one aspect of the present invention, there is provided a partition construction consisting of first and second elongated members mounted together by a latch mechanism. Each of the elongated members consists of an extrusion having a square profile with four sides, four corners, a central portion, and four channels with each channel positioned between adjacent corners. The elongated members each have an end. The latch mechanism includes a strike plate mounted to an end of one of the elongated members. The strike plate is a square flat member having four corner portions separated from each other by a gap with each corner portion being linked to a central hub portion by an arm, each corner portion having a pair of hooks projecting from a first side of the corner portion, the strike plate dimensioned such that the strike plate fits flush onto the end of the elongated members with the corners of the strike plate overlapping the corners elongated members. The latch mechanism further includes a latch having a base mountable to the second elongated element, the latch having a bail pivotally mounted to the base. The bail is dimensioned and configured to engage two of the hooks of the strike plate such that the bail engages one hook on adjacent corner portions of the bail when the latch is positioned adjacent the strike plate. The latch is movable between an elevated position wherein the bail is free of the hooks and a locked position wherein the bail engages the bail and biases the first elongated member towards the second elongated member.

In accordance with another aspect of the present invention, there is provided partition construction consisting of first and second extrusions which are mounted together with a latch mechanism. Each of the extrusions have identical rectangular profiles, each profile having a width, four sides, four corners, a central portion, and four channels with each channel positioned between adjacent corners, with each elongated member having an end. The latch mechanism includes a latch mounted on one extrusion which is configured to mount to a strike plate mounted on the other extrusion. The strike plate consists of a rectangular member having a flat surface and a width equal to the width of the profile, the rectangular member having four side edges with each side edge having a pair of hooks projecting from the flat surface. Each pair of hooks is separated by a distance which is less than the width of the strike plate. The rectangular member also has a hub mountable to the central portion of the extrusions. The strike plate is mounted to the end of the first extrusion such that the rectangular member aligns with the profile of the first extrusion. The latch is mounted to the side of the second extrusion adjacent the second extrusion's end for perpendicularly mounting the end of the second extrusion to end of the first extrusion. The latch has a bail which is movable between locked and opened positions. The bail is dimensioned and configured to be less wide than the width of the strike plate but wide enough to engage the pair of hooks at one of the side edges of the strike plate when the latch is in its locked position, the latch configured to position the bail to be free of the hooks when the bail is in it's opened position. The latch is further configured to bias the first extrusion towards the second extrusion when the bail is in its locked position.

In accordance with another aspect of the present invention, there is provided a latch mechanism for mounting up to five elongated extrusions at their ends, each extrusion having identical rectangular profiles, each profile having a width, four sides, four corners, a central portion, and four channels with each channel positioned between adjacent corners. The latch mechanism consists of a strike plate mounted to an end of one of the elongated extrusions and latches mounted on the ends of each of the other four elongated extrusions. The strike plate has a central portion and four sides, each side having a channel opening and a pair of hooks, the strike plate dimensioned and configured to mount flush on the end of the elongated extrusions with the channel openings aligned with the channels. Each of the latches has a base and a bail, the base configured to attach to the end of one of the elongated extrusions, and the bail is dimensioned to engage one of the pair of hooks. The bail is pivotally mounted to the base and movable between an open position wherein the bail is positioned away from the base and a locked position wherein the bail engages the pair of hooks and is positioned closer to the base. The strike plate, bails and hooks are dimensioned and configured such that up to four of the latches can be latched to the strike plate to simultaneously mount four elongated extrusions around the fifth elongated extrusion.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention.

DESCRIPTION OF THE DRAWINGS

In the drawings like characters of reference indicate corresponding parts in the different figures.

DETAILED DESCRIPTION OF THE INVENTION

Figure 1:
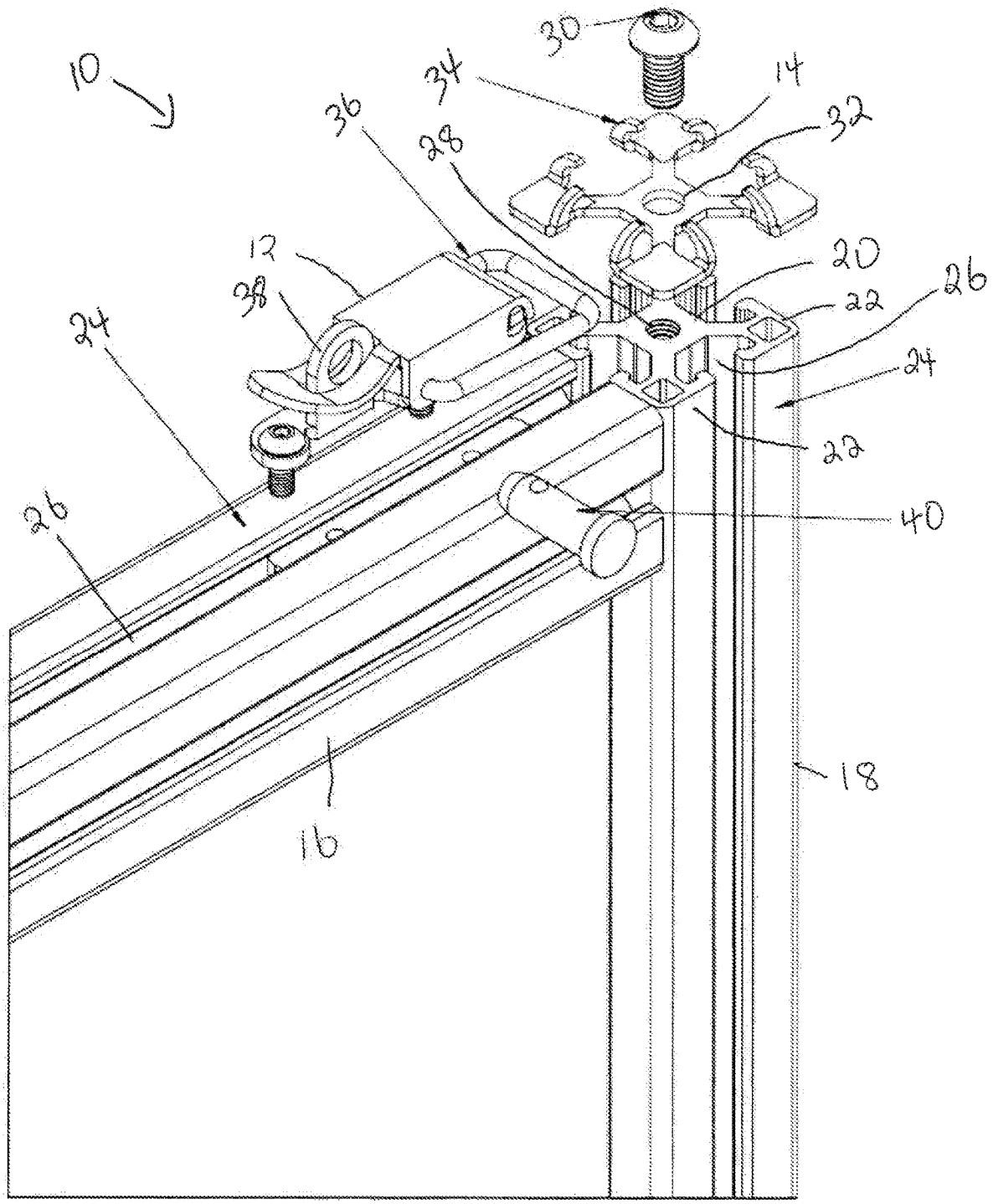
FIG. 1 is a partially exploded view of a latch connector made in accordance with the present invention.

Referring firstly to FIG. 1, a latch system for latching elongated extrusions together to form a construction is shown generally as item 10 and consists of latch 12 and strike plate 14 which mountable to extrusions 16 and 18, respectively. Extrusions 16 and 18 have identical cross-sectional profiles. The profile of extrusions 16 and 18 have a central portion 20, four corners 22, four sides 24 and four elongated channels 26. Channels 26 separate adjacent corners 22. Central portion 20 has a threaded opening 28 which is configured to mate to bolt 30 which permits strike plate 14 to be mounted to the end of extrusion 18 by passing the bolt through aperture 32 in the strike plate. Strike plate 14 has a plurality of hooks 34 which are configured to engage with bail 36 of latch 12. Latch 12 can be placed in a locked orientation as shown in FIG. 1 and kept in the locked orientation by means of keeper 40 being inserted into catch 38.

Figure 2:
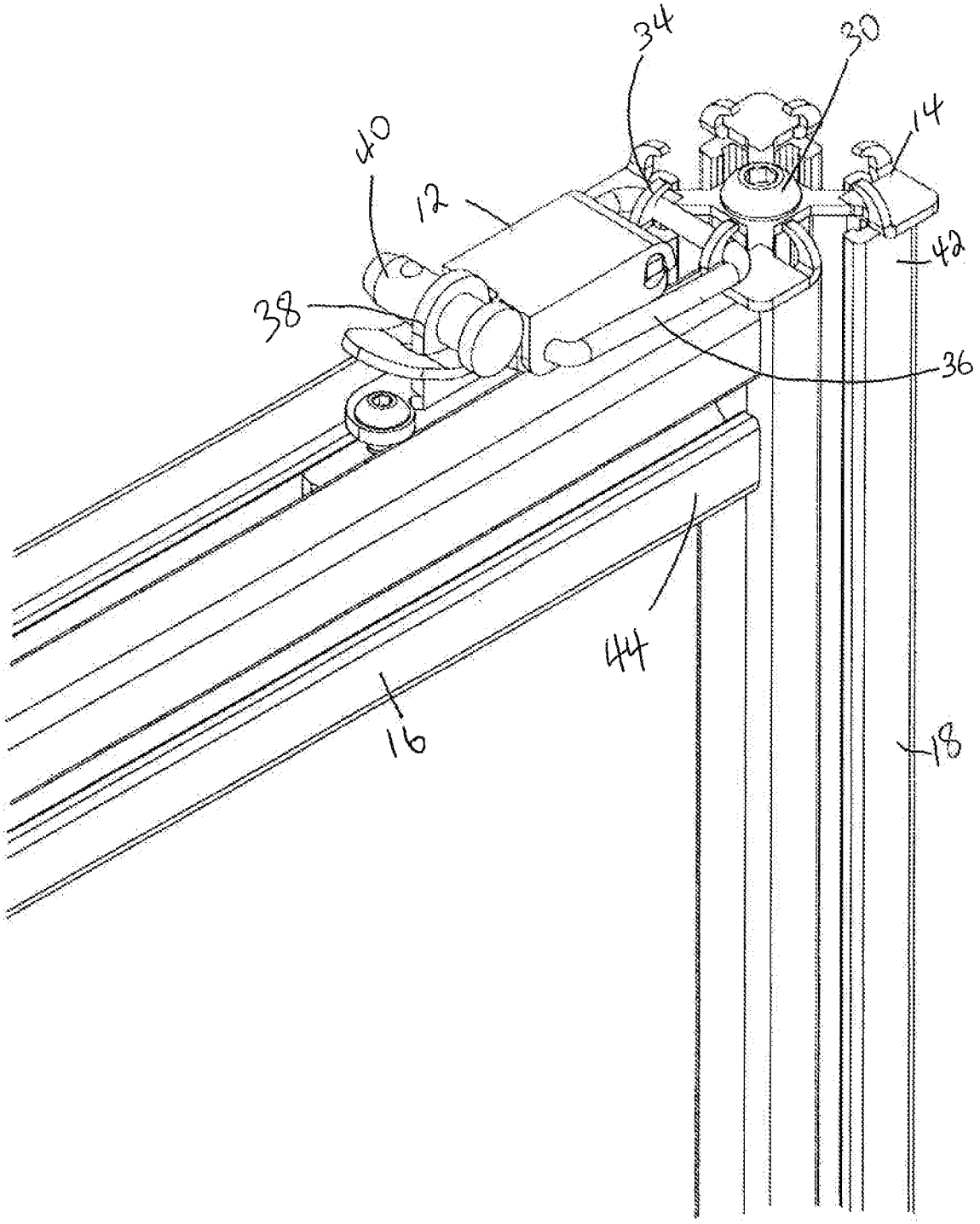
FIG. 2 is a perspective view of the latch connector shown in FIG. 2 mounting one profile member to another profile member.

Referring now to FIG. 2, extrusion 16 can be rigidly secured to extrusion 18 by positioning end 44 of extrusion 16 perpendicular to end 42 of extrusion 18 and placing latch 12 into its locked orientation while bail 36 engages hooks 34 on strike plate 14 which has been secured to end 42 of extrusion 18 by bolt 30. When latch 12 is in its locked orientation and bail 36 engages hooks 34, the latch biases ends 44 and 42 towards each other thereby securing extrusions 16 and 18 to each other. Keeper 40 and catch 38 ensure that latch 12 does not accidentally loosen the connection between the two extrusions.

Figure 3:
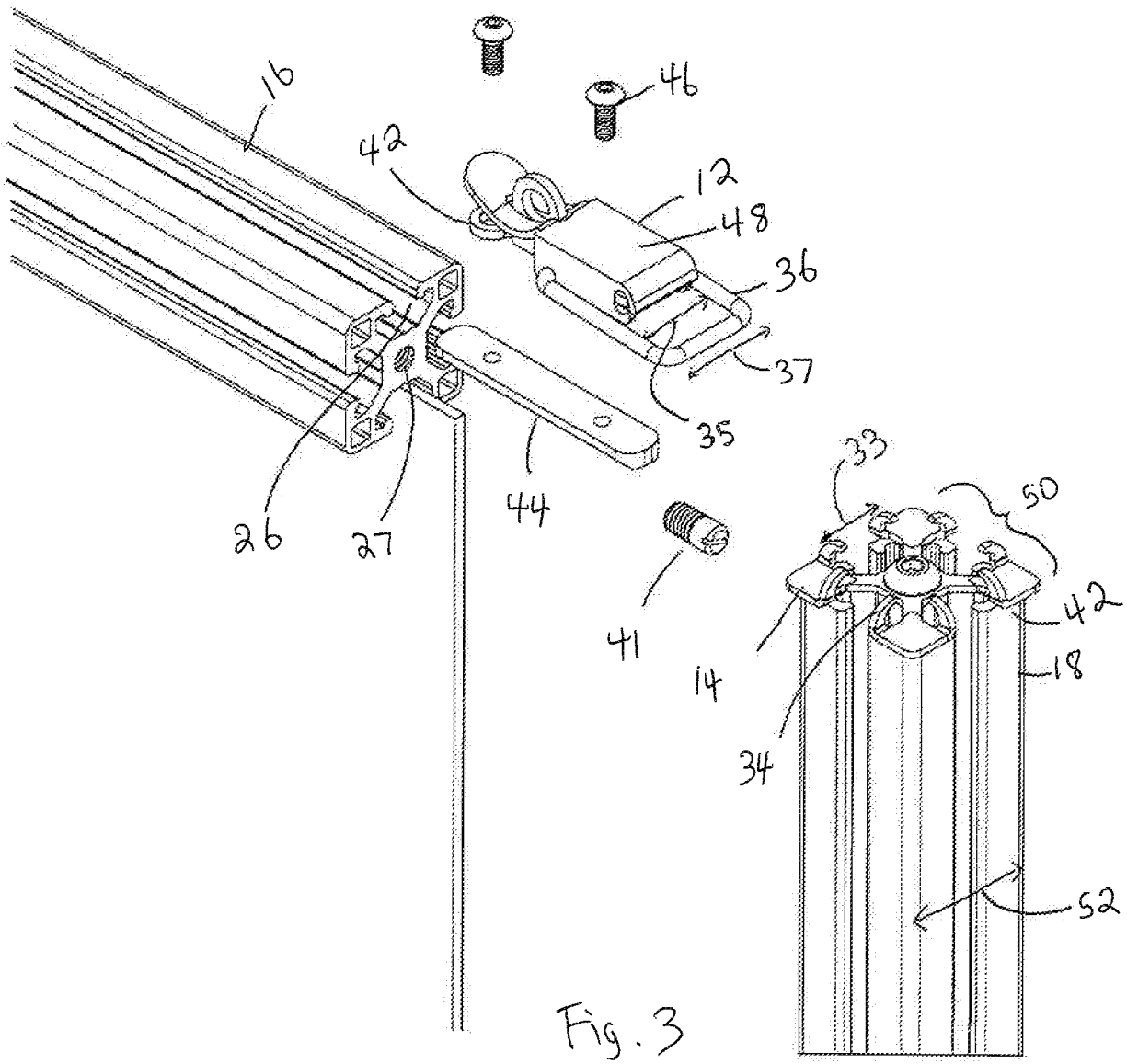
FIG. 3 is a partially exploded view of the latch connector shown in FIG. 1 with the foot portion detached from the base portion.

Referring now to FIG. 3, latch 12 has base portion 42, lever portion 48 and bail 36. Base portion 42 is mountable to foot 44 which is dimensioned to fit within channel 26 and is attachable to the base portion by bolts 46. When foot 44 is inserted into channel 26 and base portion 42 is attached to the foot by bolts 46, the bolts can be tightened to firmly mount latch 12 to the end of extrusion 16. Bail 36 has an outer width 37 and an inner width of 35 which are sufficiently wide to engage a pair of hooks 34. Hooks 34 have a width 33 which is slightly less than inner width 35 of the bail to permit bail 36 to engage with the hooks. Width 37 of bail 36 is narrower than width 50 of strike plate 14. The width 50 of strike plate 14 is preferably al little wider than width 52 of extrusion 18 so that bails 36 can engage hooks 34 of the strike plate with sufficient room so that up to four latches 12 can be latched to the strike plate (see FIG. 8). Pin 41 can be attached to tapered hole 27 in order to fine tune how close extrusion 16 fits onto extrusion 18.

Figure 9:
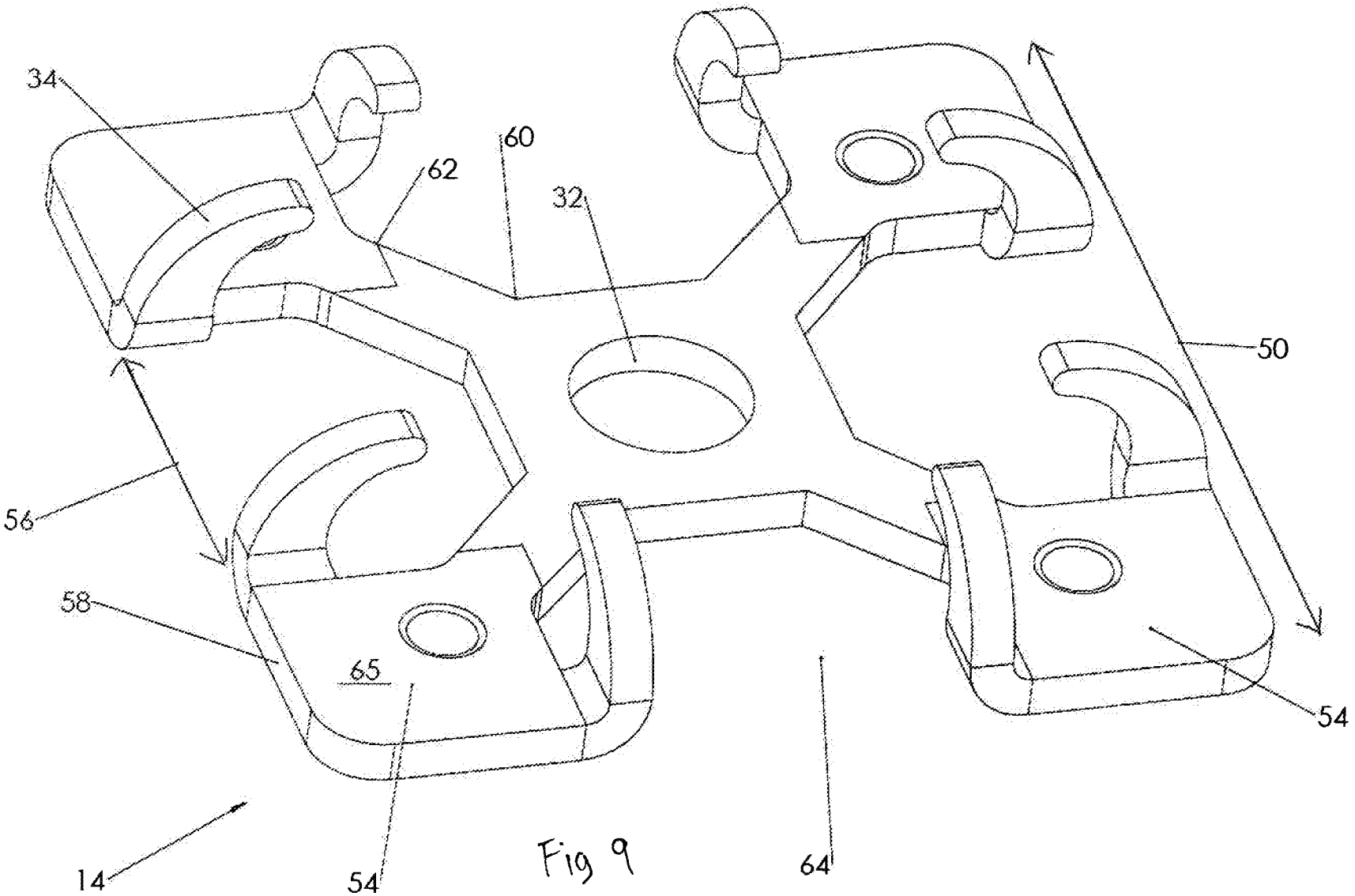
FIG. 9 is a perspective view of the strike plate portion of the present invention.

Referring now to FIG. 9, strike plate 14 consists of a substantially flat plate made of a rigid and strong material such as a high strength plastic, or a metal such as steel or aluminum Due to the low cost of steel stampings, strike plate 14 preferably consists of a substantially flat steel stamping. Strike plate 1 is substantially cross shaped to form a square having four side edges 58 and four corners 54 separated by gaps 56. Corner portions 54 have a flat surface 65 from which hooks 34 project upwards. Each corner portion 54 is connected to central portion 60 by arms 62. A pair of hooks 34 are formed on each corner portion 54 and set 90° to each other such that each side 58 has a pair of parallel hooks set on adjacent corner portions. The pair of parallel hooks formed on adjacent corner portions are separated from each other by gap 56. Gap 56 is less than diameter 50 of the strike plate. Aperture 32 is formed on central portion 60 to permit the strike plate to be mounted by a screw or bolt. Gaps 56 communicate with openings 64 which prevent the strike plate from obstructing channels 26 (see FIG. 1) of the extrusion when the strike plate is mounted to the end of the extrusion. It will be appreciated that the channels are often used to attach panels, windows, brackets and other items, so it is often important to give easy access to the channels without obstructing them.

Figure 4:
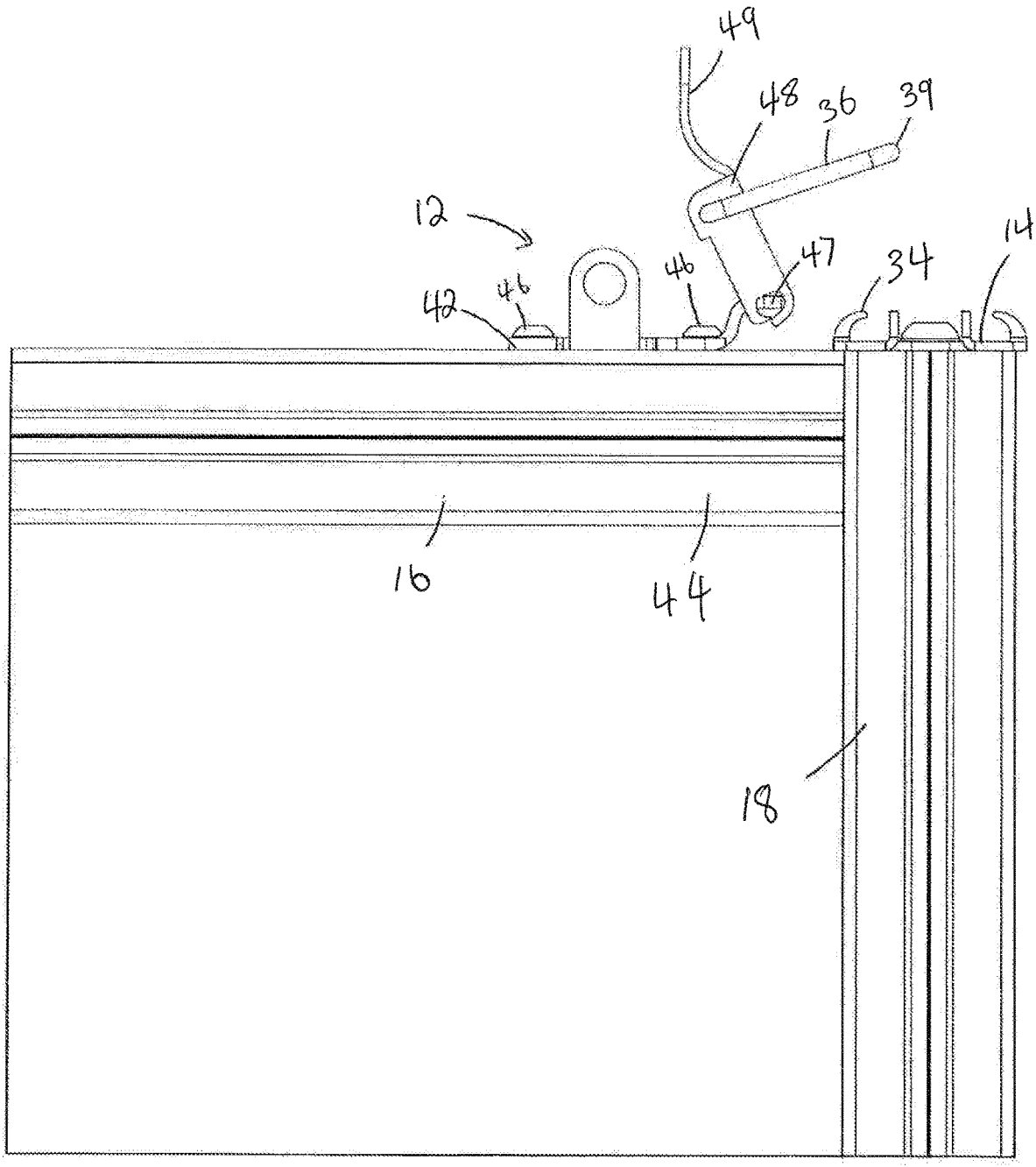
FIG. 4 is a side view of the latch connector shown in FIG. 1 showing the latch in its opened state with the bail free from the hooks of the strike plate.

Referring now to FIG. 4, latch 12 can be placed in an open orientation wherein bail 36 is positioned away from base portion 42 sufficiently to permit the bail to be free of hooks 34. In this open position, end 39 of bail 36 is positioned further away from base portion 42. Bail 36 is movably coupled to base portion 42 by attachment to lever portion 48 which is in turn pivotally connected to the base portion at point 47. Grip 49 is positioned on lever portion 48 to permit the user to move the lever portion. Bolts 46 secure latch 12 adjacent end 44 of extrusion 16 by screwing onto foot 44 (see FIG. 3).

Figure 5:
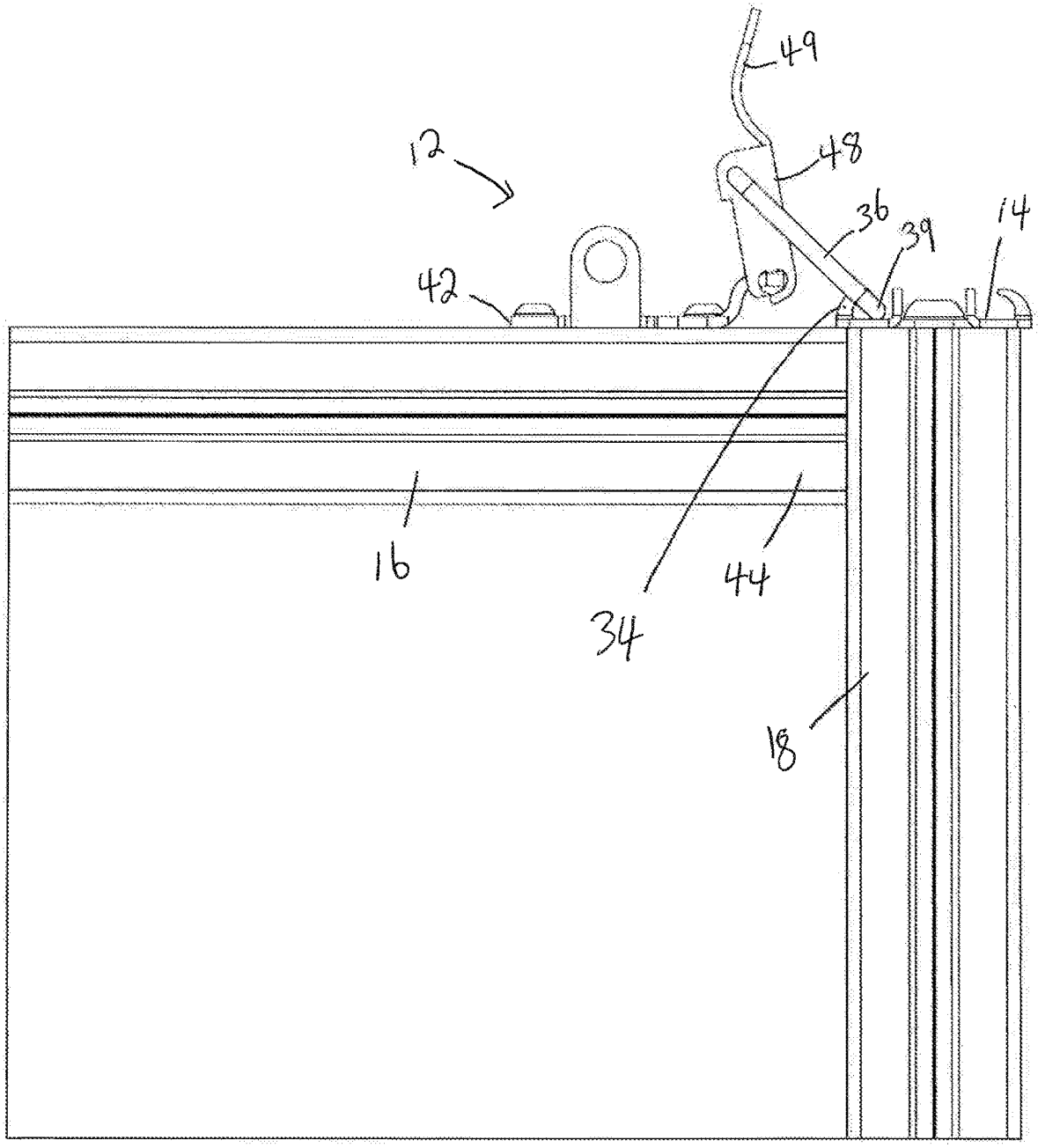
FIG. 5 is a side view of the latch connector shown in FIG. 1 showing the latch in its opened state with the bail positioned at the hooks of the strike plate.
Figure 6:
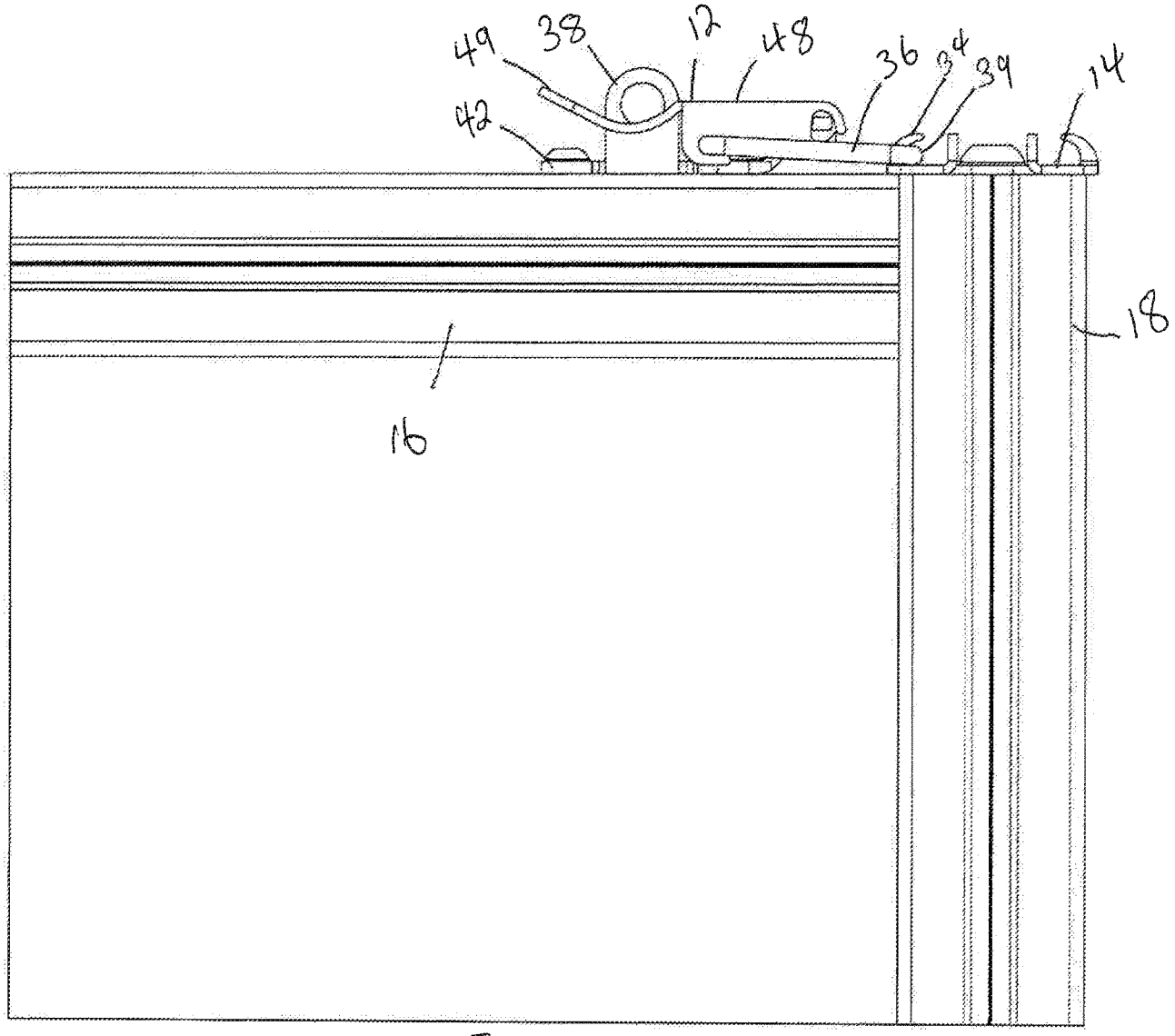
FIG. 6 is a side view of the latch connector shown in FIG. 1 showing the latch in its closed position with the bail engaging the hooks of the strike plate.

Referring now to FIG. 5, latch 12 can be moved towards its locked orientation in order to secure extrusion 16 to extrusion 18. While latch 12 is still in its open orientation, bail 36 is lowered such that end 39 of the bail is immediately adjacent hooks 34. Grip 49 can then be engaged by the user to pivot lever portion 48 towards base portion 42. As the lever portion is positioned towards base portion 42, end 39 is moved towards the base portion. As shown in FIG. 6, when latch 12 is fully in its locked position, grip 49 of lever portion 48 is positioned close to base portion 42 causing end 39 of bail 36 to firmly engage hooks 34 and bias extrusion 18 towards extrusion 16. Catch 38 is clear of grip 49 allowing the latch to be secured in its locked orientation by the use of keeper 40 (see FIG. 1).

Figure 7:
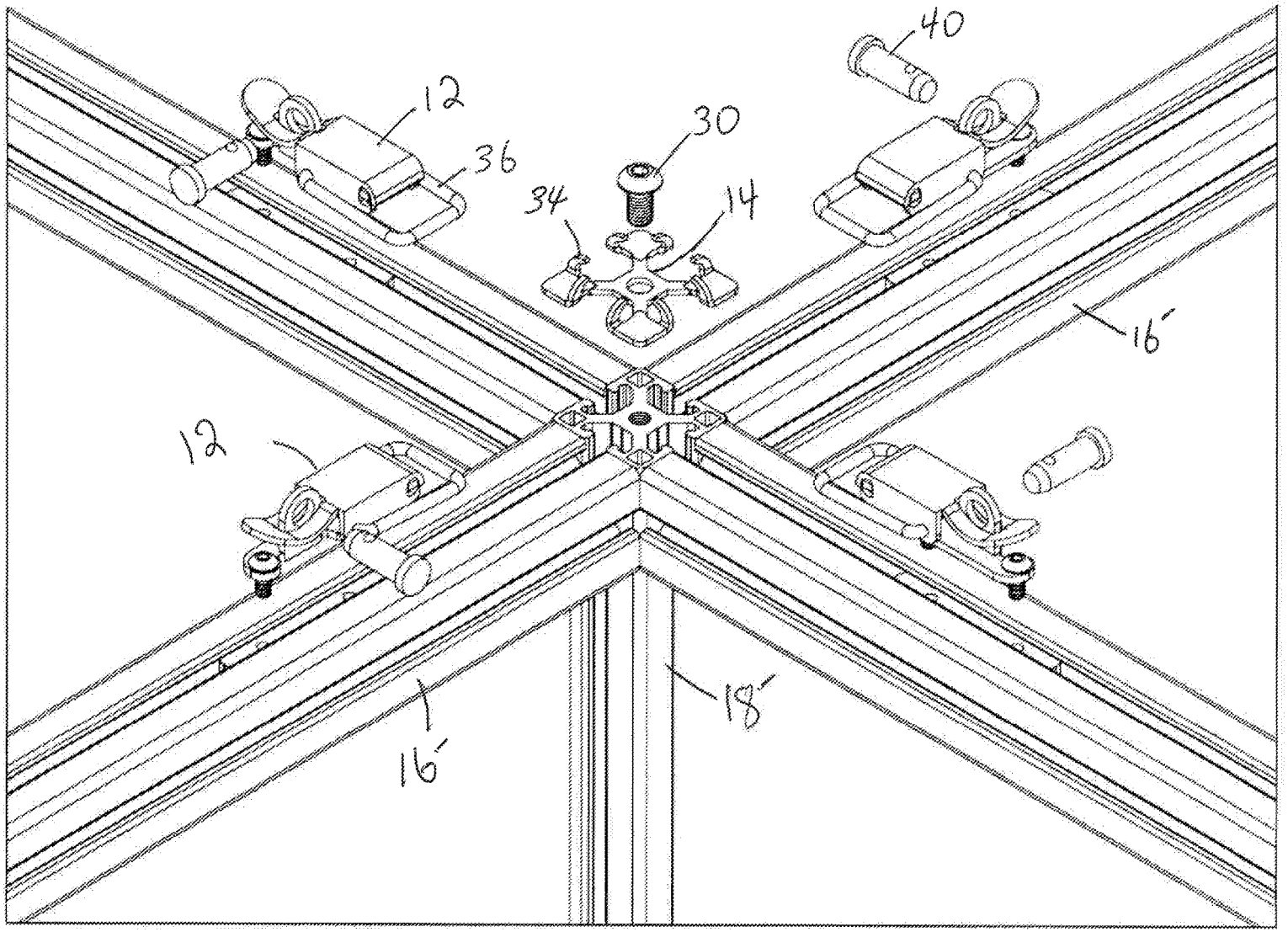
FIG. 7 is an exploded view of latches made in accordance with the present invention being used to mount four extrusion members to a fifth extrusion members.
Figure 8:
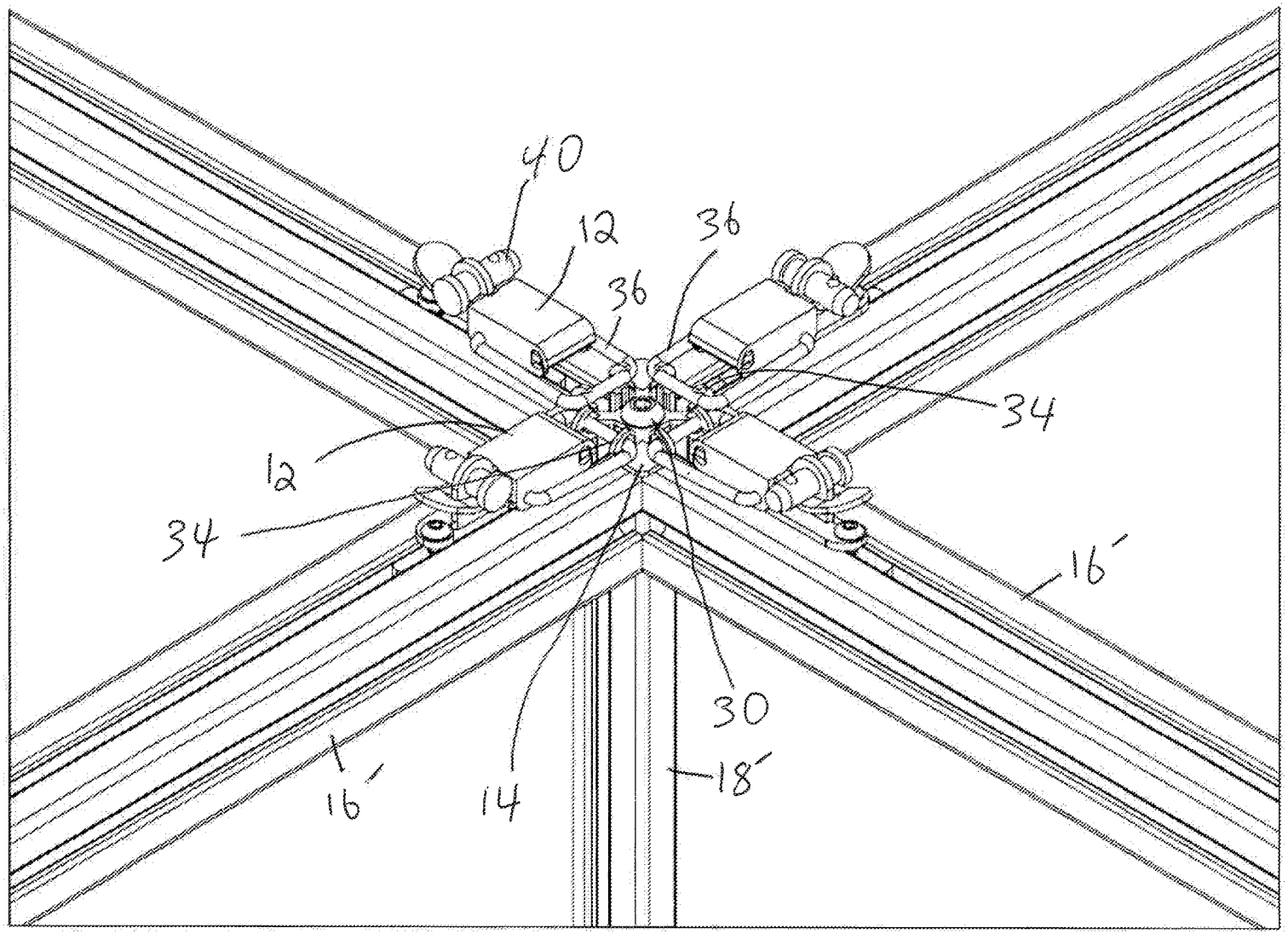
FIG. 8 is a perspective view of the latches of FIG. 7 mounting the five extrusion members together.

Referring now to FIGS. 7 and 8, the latch and strike plate mechanism of the present invention can be used to join up to five separate extrusions together by latching four extrusions perpendicularly around a central fifth extrusion. In the case illustrated in FIG. 7, extrusion 18' acts the central extrusion and extrusions 16' surround the central extrusion. Each extrusion 16' is provided with a latch 12 mounted thereto, adjacent the end of the extrusion. Strike plate 14 is mounted onto the end of extrusion 18' by bolt 30. The ends of extrusions 16' are positioned against the end of extrusion 18' such that latches 12 are adjacent strike plate 14. Bails 36 of each latch is then positioned to engage hooks 34 of the strike plate and placed in their locked orientation as shown in FIG. 8. The latches then be secured in their locked orientation by use of keepers 40. Bails 36 are sufficiently narrow and hooks 34 are sufficiently close such that the bails of different latches are sufficiently far away from each other that they do not interfere with each other. The bails being narrower than the strike plate make it possible for all four latches to be mounted to the same strike plate.

Figure 10:
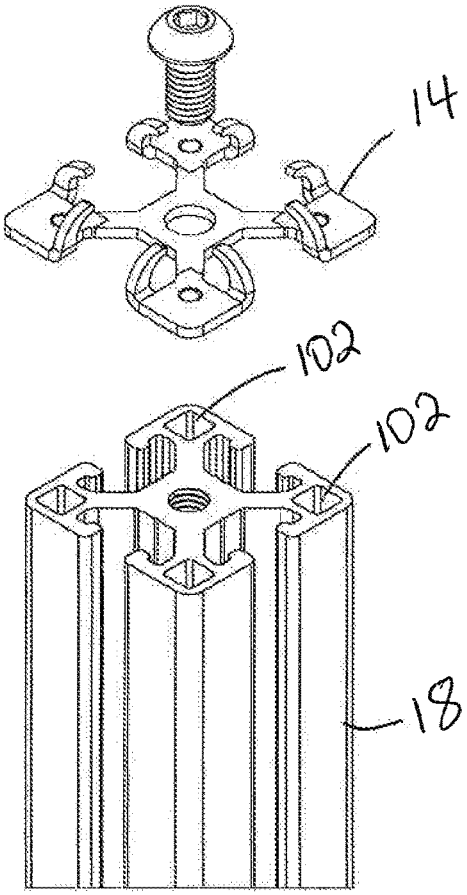
FIG. 10 is a perspective view from above of the strike plate portion of the present invention being attached to an extrusion.
Figure 11:
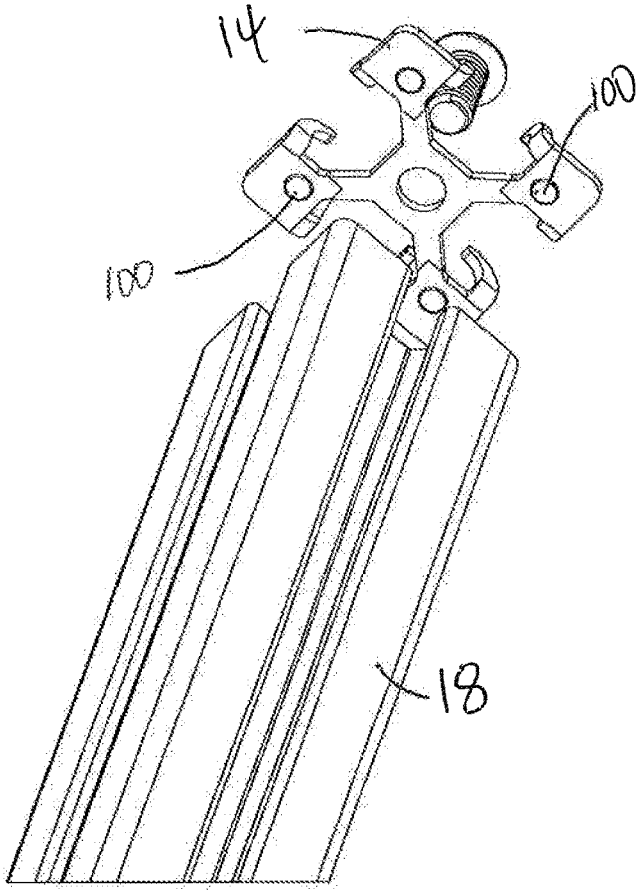
FIG. 11 is a perspective view from below of the strike plate portion of the present invention being attached to an extrusion.

Referring now to FIGS. 10 and 11, each strike plate has at least one indexing member 100 located at a bottom portion of the strike plate. Indexing members 100 permit the strike plate to be self-positioning on the end of extrusion 18 such that the strike pate and extrusion are coaxially aligned. Preferably, indexing members 100 consist of bumps formed in the strike plate which are dimensioned and positioned to project inwardly in spaces 102 in the end of extrusion 18 thereby aligning the strike plate squarely on the end of the extrusion. Other indexing structures may be used such as grooves or fingers.

The present invention has several advantages. Firstly, it is possible to quickly assemble and disassemble a partition by the use of latches and strike plates. As a first step, a strike plate can be firmly attached to the end of a first extrusion and a latch can be loosely attached to the end of a second extrusion which is to be attached to the first extrusion. The second extrusion can be moved into position against the end of the first extrusion and the position of the latch can be adjusted by moving along the second extrusion until the latch is ideally placed to firmly engage the strike plate when the latch is locked. The ideal position of the latch can then be carefully measured and the remaining extrusions can be fitted with the latches position accordingly. The user can then simply position the horizontal extrusions to the vertical extrusion and manually engage the latches without the aid of tools. It is possible to quickly assemble the framework for a series of partitions and offices by pre-attaching the strike plates and latches to the extrusions and them simply positioning them in the desired orientation and latching them into place by hand. This makes assembly easy and quick. The construction can be disassembled just as quickly by hand without the use of tools. The latch and strike plate combination make it possible to assemble and disassemble these constructions much more quickly than by using standard screw in bolts and brackets.

It will be appreciated that while the strike plate and latch combination of the present invention are particularly useful for building partitions, they can also be applied to any construction where up to four members need to be quickly mounted to a central members, such as in a temporary barrier structure, a path divider, temporary fencing and the like. The present invention can also be used to quickly erect temporary walls and partitions to form kiosks, displays, restaurant dividers, signs and screens/partitions used to limit the person to person transmission of pathogens. In fact, the present invention is suitable for constructing any sort of structure, either permanent or temporary where multiple horizontal members need to be quickly attached or detached from central column members.

A specific embodiment of the present invention has been disclosed; however, several variations of the disclosed embodiment could be envisioned as within the scope of this invention. It is to be understood that the present invention is not limited to the embodiments described above, but encompasses any and all embodiments within the scope of the following claims Therefore, what is claimed is:

1. A construction comprising:

first and second elongated members, each of said elongated members comprising an extrusion having a rectangular profile with four sides, four corners, a central portion, and four channels with each channel positioned between adjacent corners, each elongated member having an end;

a strike plate comprising a rectangular flat member having four corner portions separated from each other by a gap with each corner portion being linked to a central portion by an arm, each corner portion having a pair of hooks projecting from a first side of the corner portion, the strike plate dimensioned such that the strike plate fits transversely onto the end of the elongated members with the corners of the strike plate overlapping the corners of the elongated members, the strike plate being mountable to the end of the first elongated member;

a latch having a base mountable to the second elongated member, the latch having a bail pivotally mounted to the base, the bail dimensioned and configured to engage two of the hooks of the strike plate such that the bail engages one hook on adjacent corner portions of the bail when the latch is positioned adjacent the strike plate, the latch being movable between an elevated position wherein the bail is free of the hooks and a locked position wherein the bail engages the hooks and biases the first elongated member towards the second elongated member.

2. The construction defined in claim 1 wherein the latch comprises a foot portion mounted to the base, the foot dimensioned to fit within one of the channels of the extrusion, the foot and base configured to lock the foot within the channel to secure the base firmly onto the end of the extrusion.

3. The construction of claim 1 wherein the central portion of the extrusion has a threaded opening and strike plate has an aperture positioned to permit the strike plate to be mounted to the end of the extrusion by threading a mounting bolt onto the extrusion through the aperture.

4. The construction of claim 3 wherein the latch comprises a foot portion mounted to the base, the foot dimensioned to fit within one of the channels of the extrusion, the foot and base configured to lock the foot within the channel to secure the base firmly onto the end of the extrusion.

5. The construction of claim 4 wherein the latches and strike plate are dimensioned and configured such that up to five identical elongated members can be mounted together by latching four elongated members by their ends to an end of the fifth elongated member, the fifth elongated member having the strike plate mounted thereto, the hooks and bails being dimensioned such that there is room for each bail can engage a pair of hooks.

6. The construction of claim 4 wherein the strike pate is square and has a width, the distance separating the hooks of adjacent corner portions being narrower than said width, the bail having a diameter less than the width of the strike plate but sufficient to engage the hooks of adjacent corner portions of the strike plate, the gaps being configured such that the strike plate does not obstruct the channels.

7. The construction of claim 1 wherein the strike plate has an upper surface from which the hooks project and a lower surface opposite the upper surface, the lower surface having at least one indexing member configured to position the central portion of the strike plate in a coaxially aligned position when the strike plate is mounted to the end of the elongated member, the strike plate having four gap openings configured to align with the channels of the elongated extrusion such that said channels are not obstructed by the strike plate.

8. A construction comprising:

first and second extrusions each having identical rectangular profiles, each profile having a width, four sides, four corners, a central portion, and four channels with each channel positioned between adjacent corners, each elongated member having an end;

a strike plate comprising a rectangular member having a flat surface and a width dimensioned to overlap the profile, the rectangular member having four side edges with each side edge having a pair of hooks projecting from the flat surface, each pair of hooks being separated by a distance which is less than the width of the strike plate, the rectangular member having a hub mountable to the central portion of the extrusions, the strike plate mounted to the end of the first extrusion such that the rectangular member aligns with the profile of the first extrusion;

a latch mounted to the side of the second extrusion adjacent the second extrusion's end for perpendicularly mounting the end of the second extrusion to end of the first extrusion, the latch having a bail which is movable between locked and opened positions, the bail being dimensioned and configured to be less wide than the width of the strike plate but wide enough to engage the pair of hooks at one of the side edges of the strike plate when the latch is in it's locked position, the latch configured to position the bail to be free of the hooks when the bail is in its opened position, the latch being further configured to bias the first extrusion towards the second extrusion when the bail is in its locked position.

9. The construction defined in claim 8 wherein the latch comprises a foot portion mounted to the base, the foot dimensioned to fit within one of the channels of the extrusion, the foot and base configured to lock the foot within the channel to secure the base firmly onto the end of the extrusion.

10. The construction of claim 8 wherein the central portion of the extrusion has a threaded opening and strike plate has an aperture positioned to permit the strike plate to be mounted to the end of the extrusion by threading a mounting bolt onto the extrusion through the aperture.

11. The construction of claim 10 wherein the latch comprises a foot portion mounted to the base, the foot dimensioned to fit within one of the channels of the extrusion, the foot and base configured to lock the foot within the channel to secure the base firmly onto the end of the extrusion.

12. The construction of claim 11 wherein the latches and strike plate are dimensioned and configured such that up to five identical elongated members can be mounted together by latching four elongated members by their ends perpendicularly to an end of the fifth elongated member, the fifth elongated member having the strike plate mounted thereto, the hooks and bails being dimensioned such that there is room for each bail to engage a pair of hooks, the rectangular member having four gap openings configured to align with the channels of the extrusion such that the strike plate does not obstruct the channels of the extrusion.

13. The construction of claim 8 wherein the strike plate has a second surface opposite the flat surface, the second surface having at least one indexing member configured to position the central portion of the strike plate in a coaxially aligned position when the strike plate is mounted to the end of the elongated extrusion, the strike plate having four gap openings configured to align with the channels of the elongated extrusion such that said channels are not obstructed by the strike plate.

14. A mounting device for mounting up to five elongated members at their ends, each elongated member having a longitudinal axis and a rectangular profile, the rectangular profiles being identical and having a width, four sides, four corners, and a central portion, the mounting device comprising:

a strike plate having a central portion and four sides, each side having a pair of hooks, the strike plate dimensioned and configured to mount transversely on the end of the elongated member;

at least one latch for latching one of the elongated members onto the strike plate, the latch having a base and a bail, the base configured to attach to one of the sides of said elongated member parallel to the longitudinal axis of said member, the bail dimensioned to engage one of the pair of hooks, the bail being pivotally mounted to the base and movable between an open position wherein the bail is positioned away from the base and a locked position wherein the bail engages the pair of hooks and is positioned closer to the base, the latch mounted sufficiently close to the end of said elongated member to permit the bail to engage the hooks and bias said elongated member towards the strike plate when the bail is in its locked position, and the strike plate, bails and hooks being dimensioned and configured such that up to four of the latches can be latched to the strike plate simultaneously to mount four elongated members around a fifth elongated member.

15. The mounting device of claim 14 wherein the strike plate is a rectangular member having a width, the strike plate having four pairs of hooks, each pair of hooks being formed on one of the sides, each pair of hooks having an outside diameter, the bail having an inside diameter and an outside diameter, the inside diameter being slightly greater than the outside diameter of the pair of hooks, the outside diameter of the bail being less than the width of the strike plate.

16. The mounting device of claim 15 wherein the width of the strike plate and the outside diameter of the bail is dimensioned such that up to four latches can be mounted to the strike plate with each of the bails engaging one of the pairs of hooks without the bails touching each other.

17. The mounting device of claim 15 wherein the outside diameter of the bail is less than the width of the elongated member.

18. The mounting device of claim 14 wherein the central portion of the elongated member has a threaded opening and strike plate has an aperture positioned to permit the strike plate to be mounted to the end of the elongated member by threading a mounting bolt onto the elongated member through the aperture.

19. The mounting device of claim 18 wherein the latch comprises a foot portion mounted to the base, the foot dimensioned to fit within a channel formed in the elongated member, the foot and base configured to lock the foot within the channel to secure the base firmly onto the end of the elongated member.

20. The mounting device of claim 14 wherein the strike plate has an upper surface from which the hooks project and a lower surface opposite the upper surface, the lower surface having at least one indexing member configured to position the central portion of the strike plate in a coaxially aligned position when the strike plate is mounted to the end of the elongated member.

* * * * *